United States Patent [19]

Öiestad

[11] Patent Number: 4,587,922

[45] Date of Patent: May 13, 1986

[54] DEVICE FOR SUSPENSION AND RELEASE OF A LIFEBOAT

[76] Inventor: Arne A. Öiestad, P.O. Box 31, N-1300 Oslo Lufthavn, Norway

[21] Appl. No.: 638,837

[22] PCT Filed: Dec. 5, 1983

[86] PCT No.: PCT/NO83/00055

§ 371 Date: Aug. 6, 1984

§ 102(e) Date: Aug. 6, 1984

[87] PCT Pub. No.: WO84/02318

PCT Pub. Date: Jun. 21, 1984

[30] Foreign Application Priority Data

Dec. 6, 1982 [NO] Norway ..... 824094

[51] Int. Cl.[4] ..... B63B 23/00

[52] U.S. Cl. ..... 114/378; 294/82.24

[58] Field of Search ..... 114/365, 367, 377, 378, 114/379, 380; 294/83 R, 83 AB, 84; 244/151 A, 151 B

[56] References Cited

U.S. PATENT DOCUMENTS

| | | | |
|---|---|---|---|
| 460,556 | 10/1891 | Capehart | 114/379 |
| 1,214,313 | 1/1917 | Kalbfleisch | 114/379 |
| 3,661,416 | 5/1972 | Bukarkin et al. | 114/378 |

*Primary Examiner*—Sherman D. Basinger

*Assistant Examiner*—Jesûs D. Sotelo

*Attorney, Agent, or Firm*—Sughrue, Mion, Zinn, Macpeak and Seas

[57] ABSTRACT

A device for the suspension and release of a lifeboat comprises a holding member (5) pivotally mounted in a support (1) for attachment to the boat, and in which a pair of concave gripping rollers (6, 7) are pivotally mounted for engagement with a spherical suspension member (8) at the end of a suspension line. The rollers are articulated to the support by respective force-transferring carrying elements (16, 17), and the holding member is shaped to maintain the rollers in force-dependent, self-blocking engagement with the suspension member when this is loaded and the holding member is in a closed position. A release device comprises an operating arm (22) pivotally mounted in the support (1) and rotatable so that the holding member is forcedly driven in an engagement-releasing movement, and which, by a safety device (24) is lockable in a position in which the holding member is blocked in the closed position. One (6) of the gripping rollers (6, 7) is movable away from the other roller (7) when the holding member is blocked in the closed position without the suspension member (8) being engaged, so that introduction and reengagement of the suspension member can be effected by a simple one-handed operation.

10 Claims, 10 Drawing Figures

DEVICE FOR SUSPENSION AND RELEASE OF A LIFEBOAT

BACKGROUND OF THE INVENTION

The invention relates to a device for the suspension and release of a load, especially lifeboats and the like, comprising an engagement means arranged for releasable engagement with a suspension member at the end of a suspension line, and a release means with a disengageable safety means.

In connection with devices for the suspension and release of rescue crafts on ships or offshore structures, certain operational demands are imposed with a view to achieving reliability and safety in use. Thus, it is a requirement that the suspension arrangement is to be such that the lifeboat shall be able to be released under full load in the suspension line, i.e. with the weight of the boat and equipment and the number of persons on board for which the boat is approved, and also when the suspension line forms an angle of up to 45° with the vertical, irrespective of direction. Further, it is an operational demand that release and reengagement shall be able to be effected with one hand while holding on with the other. Release shall also be able to take place without any load in the suspension line, i.e. when the boat is afloat.

SUMMARY OF THE INVENTION

Thus, it is an object of the invention to provide a device of the type set forth which in a safe manner fulfils the operational demands stated above, and which has a sturdy and durable structure.

It is also an object of the invention to provide such a device having a structure enabling self-release when the suspension line is relieved, i.e. is without any load when the rescue craft is afloat, provided the release safety device is disengaged.

The above-mentioned objects are achieved by means of a device which, according to the invention, is characterized in that the engagement means is mounted in a holding means which is pivotally mounted in a support for attachment to the rescue craft, the engagement means comprising a pair of mutually movable gripping members for engagement with the suspension member in such a manner that, under load, it tends to urge the gripping members away from each other, the gripping members being articulated to the support by way of respective force-transferring carrying elements, and the holding means being shaped to hold the gripping member in force-dependent, self-blocking engagement with the suspension member when this is loaded and the holding means is in a closing position. The release means comprises an operating member which is mounted in the support and by the safety means is lockable in a position in which the holding means is blocked in its closing position, and which, when the safety means is disengaged, is movable so that the holding means is forcedly driven in an engagement-releasing movement, and that one of the gripping members, when the holding means is blocked in the closing position without the suspension member being engaged, is arranged to be movable away from the other gripping member to allow introduction and reengagement of the suspension member.

In an advantageous embodiment said self-release without any load is achieved in that the holding means is pivotally mounted in the support at one end so that the force-dependent self-blocking is counteracted by a moment caused by the weight of the holding means, whereby the holding means, when the safety means is disengaged and the load of the suspension member is eliminated, is moved to released position only as a result of its own weight and without any external influence.

In another advantageous embodiment the suspension member is a sphere and the gripping members are a pair of concave rollers which, on either side of the sphere are rotatably mounted in pivot members which, at a distance from the rollers, are pivotally mounted in the holding means. In such an embodiment the sphere under load will always exert a force attempting to urge the rollers away from each other, so that the sphere is disengaged when the rollers are allowed to move away from each other. Further, as a result of the fact that the rollers are freely rotatable, one avoids sliding friction which is a characteristic of the known hook systems.

BRIEF DESCRIPTION OF THE DRAWINGS

The invention is to be further described below in connection with an exemplary embodiment with reference to the accompanying drawings, wherein.

DETAILED DESCRIPTION OF THE PREFERRED EMBODIMENTS

Figure 1:
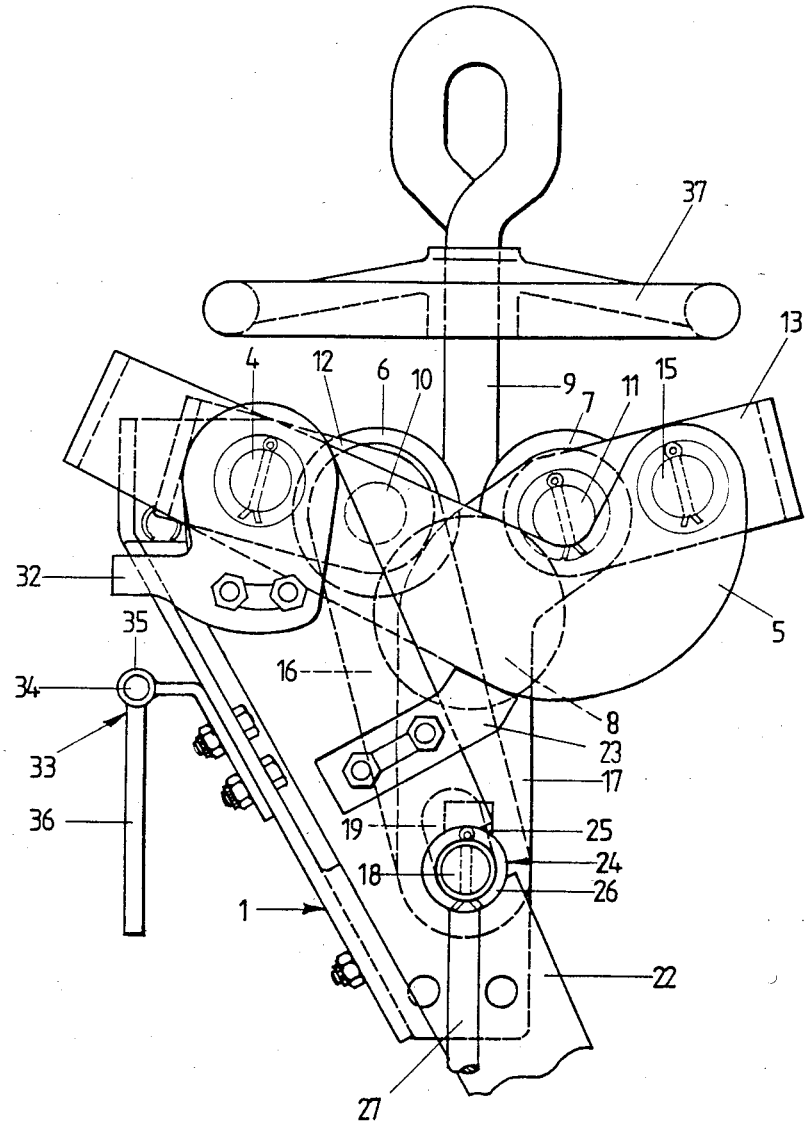
FIG. 1 shows a side view of a device according to the invention.

The device illustrated in the drawings comprises a support 1 which, in the illustrated embodiment, has lower flange portions 2 and upper flange portions 3. The lower flange portions 2 are intended for attachment to the rescue craft (not shown) which is to be suspended and released by means of the device. The upper flange portions 3 are provided with holes receiving an axle bolt 4 on which there is pivotally mounted a holding means 5 wherein the engagement means consists of a pair of mutually movable gripping members in the form of concave rollers 6 and 7, respectively, for engagement with a lifting or suspension member in the form of a spherical body 8. The spherical body 8 is attached in a suitable manner to a sphere mount in the form of an eye bolt 9 for interconnection with a suspension line (not shown). By means of respective axle bolts 10 and 11 the gripping members or rollers 6 and 7 are rotatably mounted in pivot members 12 and 13, respectively, which are pivotally mounted in the holding means 5 at a distance from the rollers 6, 7.

In the illustrated embodiment, the holding means 5 consists of an essentially U-shaped member which, at a distance from its web portion, is mounted on the bolt 4 and at the free ends of the side arms 14 is provided with a transversely extending axle bolt 15 for the support of the pivot member 13 of the gripping roller 7. In the illustrated embodiment, the pivot member 12 of the gripping roller 6 is mounted on the same bolt 4 as the holding means 5. In a manner corresponding to that of the holding means, also the pivot members 12 and 13 are constituted by U-shaped stirrups, these being mounted at their web portions on the associated bolt 4 and 15, respectively, and carrying the bearing bolts 10 and 11 of the gripping rollers 6, 7 at their ree ends. This results in a relatively compact structure consisting of sturdy members which are simple to manufacture and to assemble.

The gripping members of the engagement means, i.e. the rollers 6 and 7, which are located as shown in the holding means 5, are also articulated to the support 1 by way of respective, force-transferring carrying elements which, during load of the device, i.e. when the rescue craft (not shown) attached to the support 1 is hanging in the suspension line via the suspension member 8 in the blocked condition of the device shown in FIG. 1, transfer the acting forces to the lower flange portions 2 of the support 1 without the other flange portions 3 being subjected to any load. In the illustrated embodiment, the carrying elements for each gripping roller are constituted by a pair of link arms 16, 16 and 17,17, respectively, which, at one of their ends, are rotatably connected to the bearing bolt 10 and 11, respectively, of the roller 6 and 7, respectively, at each end of the roller, and at its other end is rotatably connected to an axle bolt 18 mounted in holes in the lower flange portions 2 of the support 1.

Figure 2:
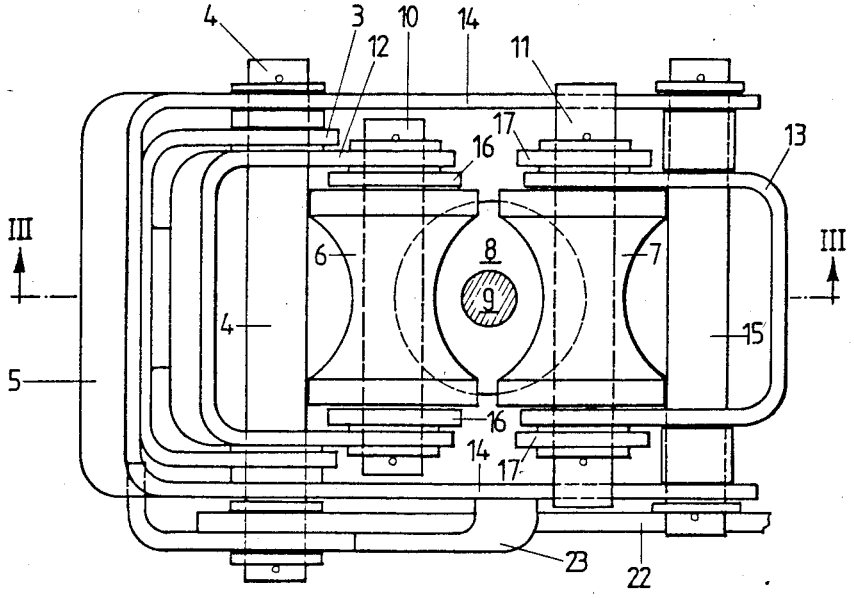
FIG. 2 shows a plan view of the device in FIG. 1, but wherein some of the details shown in FIG. 1 have been left out for the sake of clarity.
Figure 5A:
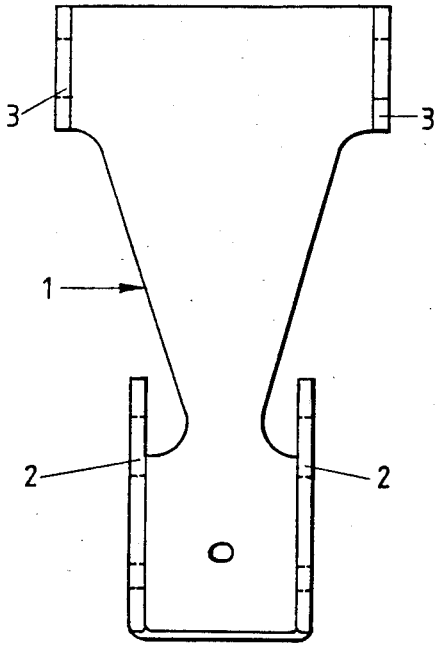
FIGS. 5A and 5B show a front view and a side view, respectively, of the support of the device.
Figure 5B:
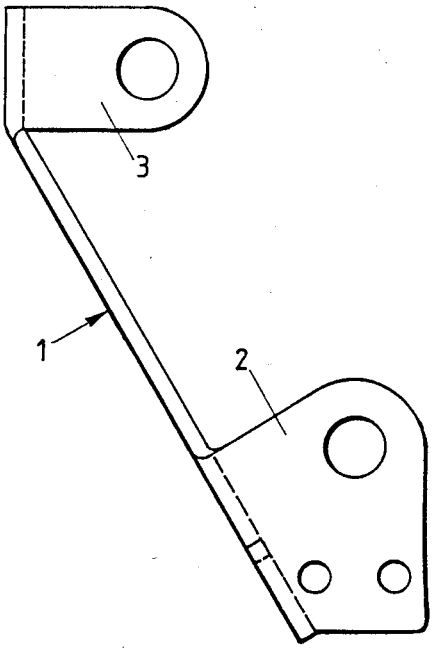

Such as appears from FIG. 2, the bearing bolt 11 for the gripping roller 7 has such a length that its end portions extend outside of the side arms 14 of the holding means 5 at their upper side and in the position shown in FIG. 1, wherein the holding means 5 is in its closed position with the gripping rollers 6, 7 in blocked engagement with the spherical body 8, is supported by upper edge portions of the side arms of the holding means. The bolts 4, 15 for the support of the pivot member 12, 13 in the holding means 5 are located at a higher level than the bearing bolts 10, 11 of the gripping rollers 6, 7 when the holding means 5 is in the closed position shown in FIG. 1. Thereby it is achieved that the end portions of the bearing bolt 11, when the device is loaded, are pressed against the holding means with a force counteracted and absorbed by the holding means. In this manner a force-dependent, self-blocking action is achieved as long as the device is loaded. Said level difference is achieved in that the side arms 14 of the holding means 5 are angularly shaped as shown in FIG. 1 and thus have a recess receiving the end portions of the bearing bolt 11 at a lower level than the level of the bolts 4 and 15. The magnitude of the self-blocking force may be given a suitable value by suitable mutual orientation of the force-absorbing members. The magnitude of the force may be determined from the force diagram shown in FIG. 8 which is to be described later on.

As the holding means 5 is pivotally mounted in the support 1 at one end thereof, the force-dependent self-blocking will be counteracted by a moment caused by the weight of the holding means itself. When the load of the suspension member is eliminated and the safety means of the device is disengaged (such as further described below), the holding means will therefore be moved to a released position only as a result of its own weight and without any external influence. The movement during release is to be described in connection with FIG. 7.

Figure 3:
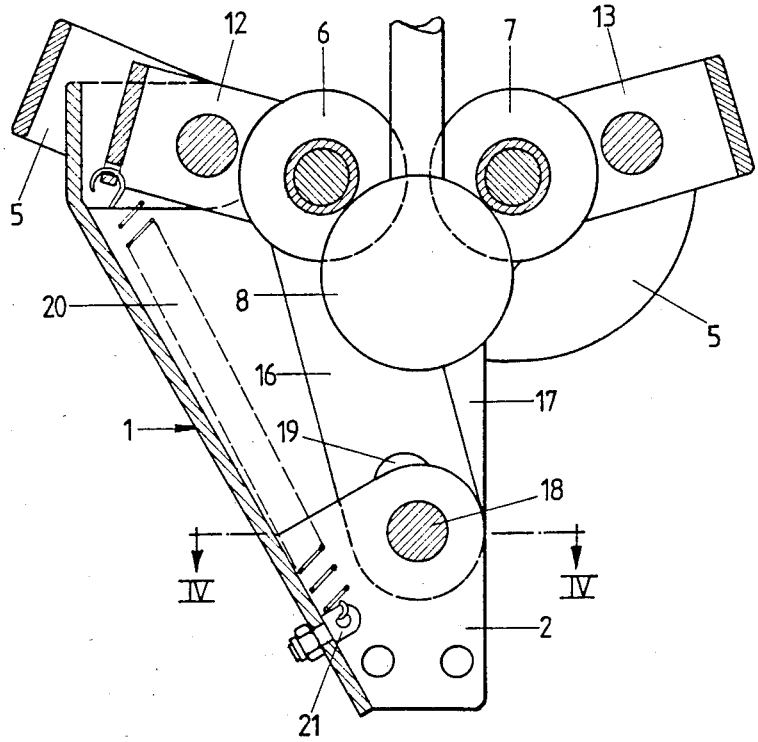
FIG. 3 shows a somewhat simplified section along the line III—III in FIG. 2.

One of the gripping rollers is arranged to be movable away from the other gripping roller when the holding means 5 is blocked in the closed position without the suspension member 8 being engaged in the device, to thereby allow introduction and reengagement of the suspension member. For this purpose the link arms 16 for the gripping roller 6 are connected to the lower bolt 18 in the support by way of a longitudinal slot 19 allowing relative movement between the link arms and the bolt. Alternatively, such a slot might be arranged at the upper ends of the link arms. As appears from FIGS. 1 and 3, the pivot member 12 for the roller 6 is connected to a helical spring 20 which at one end thereof is connected to the pivot member 12 at the end thereof located opposite to the roller 6, and its other end is connected to an eye bolt 21 attached to the support 1. Thus, the spring 20 causes a returning moment on the roller 6, so that this is returned to its initial position (in FIGS. 1 and 3) after having been pressed downwards together with the link arms 16 in connection with the introduction of the spherical body 8. By this arrangement it is achieved that the suspension member by simple, one-handed operation may be reengaged in the device when this is in a blocked and secured condition.

The release means of the device comprises an operating member which, in the illustrated embodiment, consists of an arm 22 which at one end is pivotally mounted in the support 1 and more specifically on the bolt 4 on which also the holding means 5 and the pivot member 12 of the gripping roller 6 are mounted. To the operating arm 22 there is attached an abutment block 23 which, in the position of the arm 22 shown in FIG. 1, keeps the holding means 5 blocked in the closed position, the arm 22 being locked by a safety means 24. In the illustrated locking position, the bolt 18 of the support is located in a notch 25 arranged in the operating arm 22 and having an entrance portion of a width corresponding to the diameter of the bolt 18, and an inner enlarged, circular area of a diameter corresponding to the diameter of a locking sleeve 26 constituting a part of the safety means 24. The locking sleeve 26 is inserted on the bolt 18 and keeps the operating arm locked when the sleeve is introduced in the circular area of the notch 25.

Figure 4:
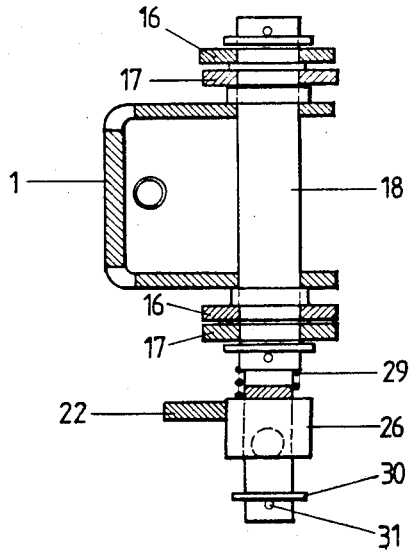
FIG. 4 shows a section along the line IV—IV in FIG. 3.
Figure 6A:
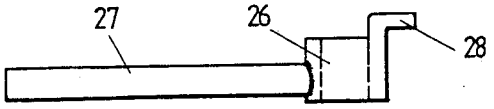
FIGS. 6A and 6B show a side view and a plan view, respectively, of the safety means for the operating member of the device.
Figure 6B:
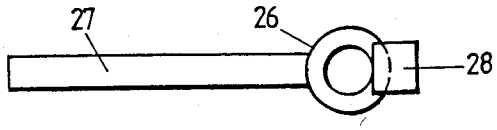

The design and operation of the safety means 24 appears when viewing FIGS. 1 and 4 compared with FIGS. 6A–6B. The locking sleeve 26 is provided with a radially extending handle arm 27 and with a diametrically opposite, radially extending projection 28 of a width which is somewhat smaller than the width of the entrance portion of the notch 25. The locking sleeve is spring-biased in outgoing direction on the bolt 18 by means of a spring 29. In the illustrated position the locking sleeve 26 is blocked in that the projection 28 bears against the inner surface of the operating arm 22. The safety mweans is disengaged in that the handle arm 27 is turned counterclockwise in FIG. 1 until the projection is aligned with the entrance portion of the notch 25, so that the spring 29 presses the locking sleeve 26 out from the notch and therewith disengages the operating arm 22. The safety means is kept in place on the bolt 18 by means of a washer 30 and a cotter pin 31.

At the pivotally mounted end the operating arm 22 is provided with a carrier or driving member 32 which is brought into engagement with the holding means 5 and exerts a torque thereon when the operating arm is turned to forcedly release the device when the suspension member is loaded. When exerting a relatively small force on the operating arm at the free end thereof, the self-blocking action is then eliminated, and the holding means 5 is moved to the open position so that the gripping roller 7 is moved to the release position such as further described in connection with the movement diagram according to FIG. 7.

As appears from FIG. 1, there is also arranged a blocking means 33 on the support 1, which means serves the purpose of preventing the swinging of the operating arm 22 to a force-releasing position in the loaded condition of the suspension member 8, even if the operating arm is disengaged to allow the release movement of the holding means 5 in an unloaded condition of the suspension member. Thus, by this means one is safeguarded against release under load, i.e. before the rescue craft is afloat. The blocking means may e.g. consist of a bolt 34 which is placed in a suitable guide 35 to be able to be moved between a non-blocking position and a blocking position wherein it extends into the swinging path of the operating arm 22 (up from the paper plane in FIG. 1). A handle arm or latch 36 is attached to the bolt and runs in a suitable slot in the guide.

In FIG. 1 a ring- or disk-shaped body 37 is shown to be mounted on the sphere mount or eyebolt 9 at a distance above the holding means 5. This disk body has a protecting function, namely to prevent unintended introduction of a hand or fingers in the device in connection with engagement of the suspension member 8. For this purpose the disk body may advantageously be made of rubber of the like. In the case that a device according to the invention is used at each end of a lifeboat, i.e. when using a two-point suspension of the boat, such a disk body may, however, also have a force-releasing function, more specifically in the case that one of the devices are released unintededly during load, so that the boat falls down at the released end and the other device gets a corresponding inclined orientation in relation to the suspension line. Provided that that side of the device facing to the right in FIG. 1, is directed towards the adjacent end of the boat, or in other words away from the central area of the boat, the disk body 37 will then strike against the holding means 5 at the release end thereof, i.e. the right side in FIG. 1, and thereby eliminate the self-blocking, so that the device is released. A presupposition is of course that the operating arm 22 is not located in the blocking position. In this case the disk body will advantageously be made of steel and has to be mounted at a suitable height above the holding means.

As appears from FIGS. 1, 2 and 4, the various members of the device are maintained in correct relative position on the respective bolts by means of a number of distance rings, distance sleeves, intermediate washers and cotter pins. The placing of these components is not further described as the arrangement appears immediately from said Figures.

Figure 7:
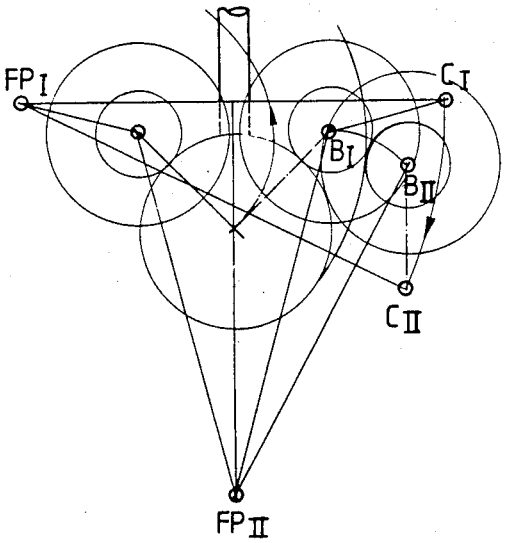
FIG. 7 is a diagram illustrating the relative orientation and movement of the engagement members in case of release.

The relative orientation and movement of the engagement members during release is shown in FIG. 7. The Figure shows the initial positions $B_I$ and $C_I$, respectively, and the end positions $B_{II}$ and $C_{II}$, respectively, of the roller 7 and the bolt 15. The fixed mounting or bearing point of the bolt 4 is designated $FP_I$, and the fixed bearing point of the bolt 18 is designated $FP_{II}$. The bolt 15 is pivoted from $C_I$ to $C_{II}$ with the point $FP_I$ as the center of rotation, whereas the bearing bolt 11 of the roller 7 is pivoted from $B_I$ to $B_{II}$ with the point $FP_{II}$ as the center of rotation, and the pivot member 13 is simultaneously pivoted about the bolt 15. The roller 7 is thereby moved in a rolling movement along the sphere 8 from $B_I$ to $B_{II}$ where the distance between the rollers 6, 7 has become so large that the sphere 8 is able to pass therebetween in rolling contact with each of the rollers. The release movement of the holding means 5 is stopped in that the bolt 15 strikes against the link arms 17. As shown in FIG. 1, the link arms 17 are angularly bent inwards to allow the necessary opening movemnent of the holding means.

Figure 8:
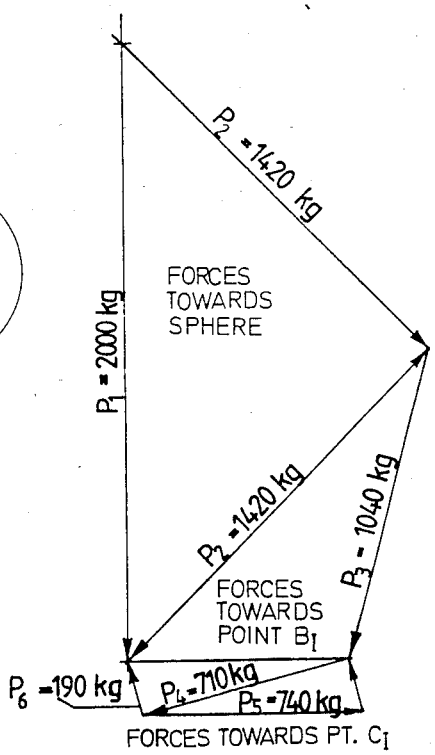
FIG. 8 is a diagram showing the forces acting in the device in case of loaded suspension member.

The force diagram in FIG. 8 illustrates the forces occurring in the device during load of the suspension member, i.e. the sphere body 8. In the diagram it is supposed that the weight held by the suspension line, is $P_1=2000$ kilograms. The directions of action of the forces are the same as in the initial position in the movement diagram of FIG. 7 and are drawn on the scale 10 mm=200 kg. The forces acting in the direction towards the spherical body are $P_2$(=1420 kg.). Further, the diagram shows the forces $P_2$ and $P_3$(=1040 kg.) acting towards the point $B_I$ (FIG. 7), and the forces $P_4$(=710 kg). and $P_5$(=740 kg.) actiing towards the point $C_I$. A force $P_6$(=190 kg.) closes the polygon of forces and is the aforementioned self-blocking force which is counteracted by the holding means 5.

I claim:

1. A device for the suspension and release of a load, especially a rescue craft or the like, comprising:

(a) engagement means including a pair of mutually movable gripping members (6, 7) for releasable engagement with a suspension member (8) at a free end of a suspension line;

(b) a holding member (5) for holding said gripping members in blocked engagement with said suspension member in a closed position; and (c) means for eliminating said blocking of the gripping members;

(d) wherein said gripping members are mounted in said holding member which in turn is pivotally mounted in a support (1) for attachment to said load;

(e) said gripping members being articulated to said support by respective force-transferring carrying elements (16, 17), and said holding member being shaped to hold said gripping members in force-dependent, self-blocking engagement with said suspension member when said suspension member is loaded and the holding member is in said closed position;

(f) wherein said blocking eliminating means comprises an operating member (22) mounted in said support and a safety means (24) lockable in a position in which the holding member is blocked in said closed position, and which, when said safety means is disengaged, is movable so that said holding member is forcedly driven in an engagement releasing movement; and (g) wherein one of said gripping members, when said holding member is blocked in said closed position without said suspension member being engaged, is arranged to be movable away from the other gripping member to allow introduction and reengagement of said suspension member.

2. A device according to claim 1, wherein the holding member (5) is pivotally mounted in the support (1) at one end thereof so that the force-dependent self-blocking is counteracted by a moment caused by the weight of the holding member, whereby the holding member, when the safety means (24) is disengaged and the load of the suspension member (8) is eliminated, is moved to a released position only as a result of its own weight and without any external influence.

3. A device according to claims 1 or 2, wherein the suspension member is a sphere (8) and the gripping members are a pair of concave rollers (6, 7) which, at either side of the sphere, are rotatably mounted in pivot members (12, 13) which are pivotally mounted in the holding member (5) at a distance from the rollers (6, 7).

4. A device according to claim 3, wherein the holding member comprises an essentially U-shaped member having side arms (14) which, at one end thereof, are rotatably mounted on a bolt (4) supported by the support (1) and also serve as a bearing shaft for the pivot member (12) of one gripping roller (6), and which at the other end are provided with a bolt (15) for the support of the pivot member (13) of the other gripping roller (7) the latter gripping roller (7) being mounted on a bolt (11) having end portions which, in the closed position of the holding member (5), are supported by upper edge portions of the side arms (14), the bolts (4, 15) for the support of the pivot member (12, 13) being located at a higher level than the bearing bolts (10, 11) of the gripping rollers (6, 7) when the holding member is in its closed position, to cause the force-dependent self-blocking of the holding member.

5. A device according to claim 4, wherein the pivot members are U-shaped stirrups (12, 13) which, at web portions thereof, are mounted on associated bolts (4, 15) and carry bearing bolts (10, 11) of the gripping rollers (6, 7) at their free ends, and wherein the force-transferring carrying elements for each gripping roller comprise pairs of link arms (16, 17) which at one end thereof are rotatably connected to the bearing bolts of the rollers at each end of the rollers, and at their other ends are rotatably connected to a bolt (18) mounted in the support (1).

6. A device according to claim 5, wherein the link arms (16) for the gripping roller (6) which is movable away from the other gripping roller (7) when the holding member (5) is blocked in the closed position without the suspension member (8) being engaged, are coupled at one end to the associated bolt (18) by a longitudinal slot (19) allowing relative movement between the arms (16, 16) and the bolt (18), and wherein a return spring (20) is provided for the return of the pivot member (12) with the movable gripping roller (6) to the initial position after said movement.

7. A device according to claim 1, wherein the operating member is an arm (22) pivotally mounted in the suppport (1) at one end thereof and at this end is provided with a driving member (32) exerting a torque on the holding member (5) by pivotal movement of the operating member arm (22) for engagement release.

8. A device according to claim 7, wherein the operating member arm (22) is mounted in the support (1) on a same bolt (4) as the holding member (5).

9. A device according to claim 8, wherein the operating member arm (22) is provided with a notch (25) for locking engagement with the safety means (24), said safety means being mounted on the bolt (18) which is mounted in the support (1) and with which the force-transferring link arms (16, 17) are connected.

10. A device according to claim 9, wherein a blocking means (33) is mounted on the support (1) for preventing swinging of the operating member arm (22) to a force-releasing position in a loaded condition even if the operating member arm is disengaged to allow the release movement of the holding member (5) in an unloaded condition of the suspension member (8).

* * * * *